US011428458B2

(12) United States Patent
Park et al.

(10) Patent No.: US 11,428,458 B2
(45) Date of Patent: Aug. 30, 2022

(54) REFRIGERATOR

(71) Applicant: LG Electronics Inc., Seoul (KR)

(72) Inventors: Kihyun Park, Seoul (KR); Kiyoung Lim, Seoul (KR); Daehyun Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 15 days.

(21) Appl. No.: 16/979,024

(22) PCT Filed: Mar. 6, 2019

(86) PCT No.: PCT/KR2019/002626
§ 371 (c)(1),
(2) Date: Sep. 8, 2020

(87) PCT Pub. No.: WO2019/172662
PCT Pub. Date: Sep. 12, 2019

(65) Prior Publication Data

US 2021/0372692 A1 Dec. 2, 2021

(30) Foreign Application Priority Data

Mar. 8, 2018 (KR) ..... 10-2018-0027288

(51) Int. Cl.
*F25D 23/00* (2006.01)
*F25D 23/06* (2006.01)
*F25D 23/02* (2006.01)

(52) U.S. Cl.
CPC ..... *F25D 23/066* (2013.01); *F25D 23/021* (2013.01); *F25D 23/067* (2013.01); *F25D 2400/08* (2013.01); *F25D 2400/18* (2013.01)

(58) Field of Classification Search
CPC .... F25D 23/066; F25D 23/021; F25D 23/067; F25D 2400/08; F25D 2400/18;
(Continued)

(56) References Cited

U.S. PATENT DOCUMENTS 3,125,387 A * 3/1964 Abrahamson ..... A47B 47/03 312/195
4,371,221 A * 2/1983 Citterio ..... A47B 53/00 312/111
(Continued)

FOREIGN PATENT DOCUMENTS

CA 2260429 * 8/1999
CA 2219184 * 8/2002
(Continued)

OTHER PUBLICATIONS

Extended European Search Report in European Appln. No. 19764058.4, dated Jul. 23, 2021.
(Continued)

*Primary Examiner* — Janet M Wilkens
(74) *Attorney, Agent, or Firm* — Fish & Richardson P.C.

(57) ABSTRACT

A refrigerator includes a cabinet and a door. The cabinet includes an inner case provided with a storage compartment and a middle plate covering an upper surface of the inner case. The door is disposed on a front portion of the cabinet to open and close the storage compartment, and the cabinet further includes a cabinet cover which is attachably and detachably coupled to an upper side of the middle plate to cover an upper surface of the cabinet.

18 Claims, 8 Drawing Sheets

(58) Field of Classification Search
CPC ..... Y10T 403/7015; Y10T 403/7035; Y10T 403/7094
USPC ..... 312/406, 201, 265.5, 265.6, 204, 400, 312/401, 228, 236, 257.1, 263
See application file for complete search history.

(56) References Cited

U.S. PATENT DOCUMENTS

| | | | | |
|---|---|---|---|---|
| 4,400,951 | A | 8/1983 | Cherry | |
| 5,738,462 | A * | 4/1998 | Petersen | F16B 12/22 312/140.2 |
| 6,004,065 | A * | 12/1999 | Higdon | A47B 13/003 108/108 |
| 2006/0284525 | A1* | 12/2006 | Gorini | A47L 15/4229 312/228 |
| 2011/0304251 | A1* | 12/2011 | Bernett | A47B 17/00 312/326 |
| 2012/0235551 | A1 | 9/2012 | Park et al. | |
| 2013/0327064 | A1* | 12/2013 | Stein | F25D 23/10 62/3.6 |
| 2019/0277555 | A1* | 9/2019 | Yoo | F25D 23/003 |

FOREIGN PATENT DOCUMENTS

| | | | |
|---|---|---|---|
| CN | 1423104 | | 6/2003 |
| DE | 19750946 | | 10/1998 |
| DE | 202013005625 | * | 11/2013 |
| EP | 3489600 | * | 5/2019 |
| GB | 1339013 | A | 11/1973 |
| JP | S46-28811 | | 10/1971 |
| JP | 2000146422 | * | 5/2000 |
| JP | 2001095627 | | 4/2001 |
| JP | 2005131966 | | 5/2005 |
| JP | 2017006297 | | 1/2017 |
| KR | 2020000007354 | | 4/2000 |
| KR | 101323876 | | 10/2013 |
| KR | 101410755 | | 6/2014 |
| KR | 201 50082059 | | 7/2015 |
| RU | 141744 | U1 | 6/2014 |
| WO | 2013182876 | * | 12/2013 |
| WO | 2018065203 | * | 4/2018 |
| WO | 2019/177315 | * | 9/2019 |

OTHER PUBLICATIONS

Australian Examination Report in AU Appln. No. 2019231480, dated Dec. 14, 2020, 6 pages.
Russian Decision to Grant in RU Appln. No. 2020131750/10, dated Dec. 15, 2020, 5 pages.
CN Office action in Chinese Appln. No. 201980006799.6, dated May 6, 2021, 12 pages (with English translation).
IN Office Action in Indian Appln. No. 202017020192, dated May 4, 2021, 6 pages.
JP Office Action in Japanese Appln. No. 2020531416, dated Apr. 6, 2021, 8 pages (with English translation).

* cited by examiner

REFRIGERATOR

CROSS-REFERENCE TO RELATED APPLICATIONS

This application is a National Stage application under 35 U.S.C. § 371 of International Application No. PCT/KR2019/002626, filed on Mar. 6, 2019, which claims the benefit of Korean Patent Application No. 10-2018-0027288, filed on Mar. 8, 2018. The disclosures of the prior applications are incorporated by reference in their entirety.

TECHNICAL FIELD

The present disclosure relates to a refrigerator.

BACKGROUND ART

In general, a refrigerator refers to a home appliance that can store objects such as foods in a storage compartment provided in a cabinet at a low temperature. The storage compartment is surrounded by an insulation wall and thus the inside of the storage compartment is maintained at a temperature lower than an external temperature.

The storage compartment is divided into a refrigerator compartment or a freezer compartment according to a temperature band of the storage compartment. In addition, foods may be stored in the refrigerator compartment or the freezer compartment according to types or states of foods.

The refrigerator may be provided in a built-in type along with other home appliances in a kitchen. In this case, the exterior of the refrigerator is designed to be well harmonized with furniture of the kitchen.

In addition, according to users' various demands in recent years, refrigerators are increasingly installed and used in other places than kitchens, such as living rooms or bedrooms.

As the installation positions of the refrigerator are diversifying, the exterior of the refrigerator is designed to be well harmonized with furniture in a space where the refrigerator is to be installed.

As a prior art document, Korean Patent Publication No. 10-1323876 discloses a cooling packaging provided with a thermoelement and a refrigerator having the same.

The refrigerator of the prior art document includes: a refrigerator main body having a refrigerator compartment formed therein; a door pivotably installed on the refrigerator main body to open and close the refrigerator compartment; a cooling packaging coupled to a main body coupling hole and provided with a thermoelement; a heat absorption unit coupled to a front end of the cooling packaging in the refrigerator compartment; a radiation unit coupled to a rear end of the cooling packaging at a rear side of the refrigerator main body; and a drain to drain condensate water generated in the refrigerator compartment to the radiation unit by using the capillary phenomenon.

When the cooling packaging provided with the thermoelement is used as in the case of the prior art document, there is an advantage that the size of the refrigerator can be reduced.

However, in the case of the prior art document, the size of the refrigerator is only reduced, and there is no change in the exterior of the refrigerator, and accordingly, there is a problem that the refrigerator is not harmonized with other surrounding structures when the refrigerator is installed in a living room or a bedroom other than a kitchen.

In addition, when the exterior of the refrigerator (in particular, an upper plate) is formed with a wood material to realize a high-grade design of the refrigerator, there may be a problem of deformation such as shrinkage, warping, or the like as time elapses.

DISCLOSURE OF THE INVENTION

Technical Problem

An object of the present disclosure is to provide a refrigerator in which a cabinet cover of a wood material defines an exterior of an upper surface of a cabinet.

In addition, an object of the present disclosure is to provide a refrigerator which can prevent deformation of a cabinet cover, which defines an exterior of an upper surface of a cabinet, such as shrinkage, warping or the like.

In addition, an object of the present disclosure is to provide a refrigerator which can have a cabinet cover, which defines an exterior of an upper surface of the refrigerator, easily removed from a cabinet and replaced.

In addition, an object of the present disclosure is to provide a refrigerator which can enhance user's convenience by reducing weight of a cabinet cover defining an exterior of an upper surface of a cabinet.

In addition, an object of the present disclosure is to provide a refrigerator which can have a thickness of a cabinet cover, which defines an exterior of an upper surface of a cabinet, reduced to the minimum.

In addition, an object of the present disclosure is to provide a refrigerator which can prevent deformation in a horizontal direction of a cabinet cover defining an exterior of an upper surface of a cabinet, as well as deformation in a forward-backward direction.

In addition, an object of the present disclosure is to provide a refrigerator which can prevent deformation and separation of a reinforcing bracket when a cabinet cover defining an exterior of an upper surface of a cabinet is deformed.

Technical Solution

To achieve the above-described objects, a refrigerator according to the present disclosure includes: a cabinet including an inner case provided with a storage compartment, and a middle plate covering an upper surface of the inner case; and a door disposed on a front portion of the cabinet to open and close the storage compartment, wherein the cabinet includes a cabinet cover which is attachably and detachably coupled to an upper side of the middle plate to cover an upper surface of the cabinet.

In the present disclosure, a plurality of reinforcing brackets formed with a metallic material and formed in a bar shape may be coupled to a lower surface of the cabinet cover in parallel with one another.

A mounting recess may be formed on a lower surface of the cabinet cover to be concave inwardly, and the reinforcing bracket may be inserted into the mounting recess.

A length of the mounting recess may be longer than a length of the reinforcing bracket.

The cabinet cover may be formed with glued laminated wood in which a plurality of planks of hardwood are arranged in parallel with one another and are glued to one another.

The reinforcing bracket may be formed in parallel with an arrangement direction of the glued laminated wood.

The reinforcing bracket has a long hole formed on a surface thereof parallel to the lower surface of the cabinet cover, and formed in parallel with a longitudinal direction of the reinforcing bracket.

A plurality of slit recesses may be formed on a lower surface of the cabinet cover to be concave inwardly in parallel with one another.

The slit recess may be formed in a direction orthogonal to the reinforcing bracket.

A plurality of cover fixing portions may be formed on a lower surface of the cabinet cover to be fixed to the middle plate.

The cover fixing portion may include: a cylindrical first portion having one side contacting the lower surface of the cabinet cover, and the other side protruding downward from the cabinet cover; and a cylindrical second portion integrally formed with the other side of the first portion and having a diameter larger than the first portion.

A recess is formed on a lower surface of the cabinet cover to receive the one side of the first portion.

the cover fixing portion may be fixed to the cabinet cover by means of a fastening member penetrating through the cover fixing portion and the cabinet cover.

The middle plate may have a cover fixing hole formed thereon to allow the cover fixing portion to be fixed thereto.

The cover fixing hole may include: a first hole which is formed to have a same or larger size as or than a size of the second portion of the cover fixing portion; and a second hole which is extended from the first hole, and is formed to have a size smaller than the size of the second portion, and same as or larger than a size of the first portion.

Advantageous Effects

According to the present disclosure suggested, since the cabinet cover of a wood material defines the exterior of the cabinet, there is an advantage that an aesthetic design of the refrigerator can be achieved.

In addition, since the cabinet cover is replaceable, there is an advantage that the refrigerator can have various exterior designs.

In addition, there is an advantage that deformation of the cabinet cover defining the exterior of the upper surface of the cabinet, such as shrinkage, warping, or the like, can be prevented.

In addition, there is an advantage that the cabinet cover defining the exterior of the upper surface of the refrigerator can be easily separated from the cabinet and can be replaced when necessary.

In addition, there is an advantage that the weight of the cabinet cover defining the exterior of the upper surface of the cabinet is reduced and thus user's convenience can be enhanced.

In addition, there is an advantage that the thickness of the cabinet cover defining the exterior of the upper surface of the cabinet is reduced to the minimum.

In addition, there is an advantage that not only deformation of the cabinet cover in the horizontal direction, which defines the exterior of the upper surface of the cabinet, but also deformation in the forward-backward direction can be prevented.

In addition, there is an advantage that, when the cabinet cover defining the exterior of the upper surface of the cabinet is deformed, deformation and release of the reinforcing bracket can be prevented.

BEST MODE

Hereinafter, embodiments of the present disclosure will be described in detail with reference to the accompanying drawings.

Figure 1:
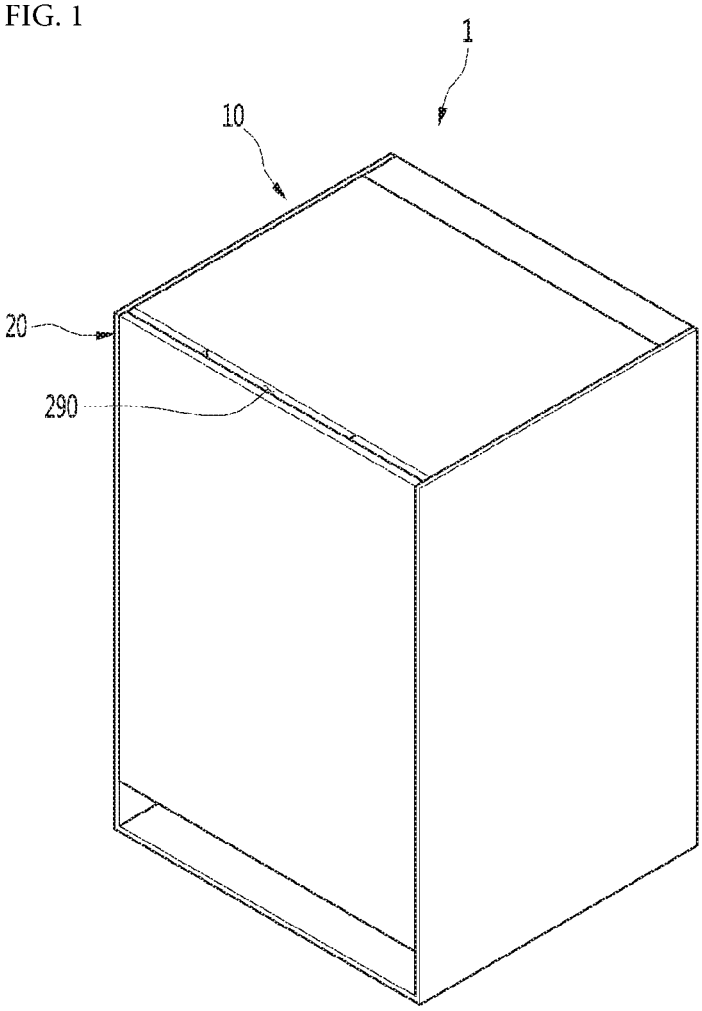
FIG. 1 is a perspective view of a refrigerator according to an embodiment of the present disclosure.
Figure 2:
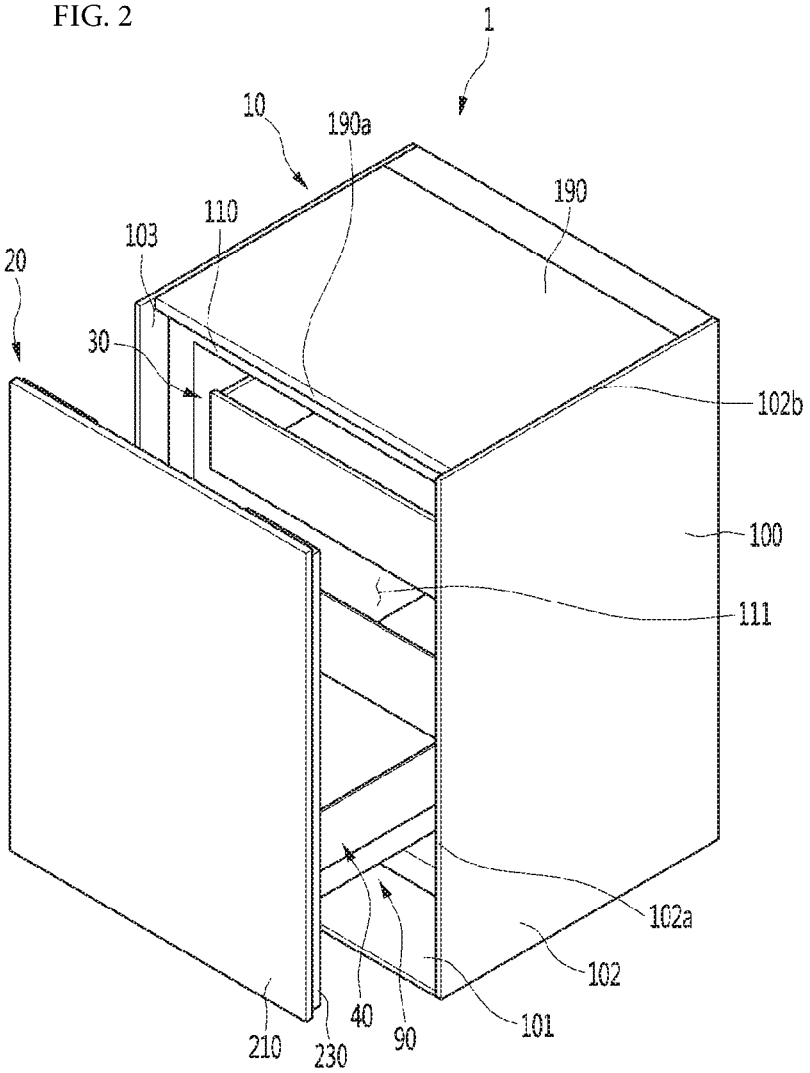
FIG. 2 is a perspective view showing a state in which a door of FIG. 1 is opened.
Figure 3:
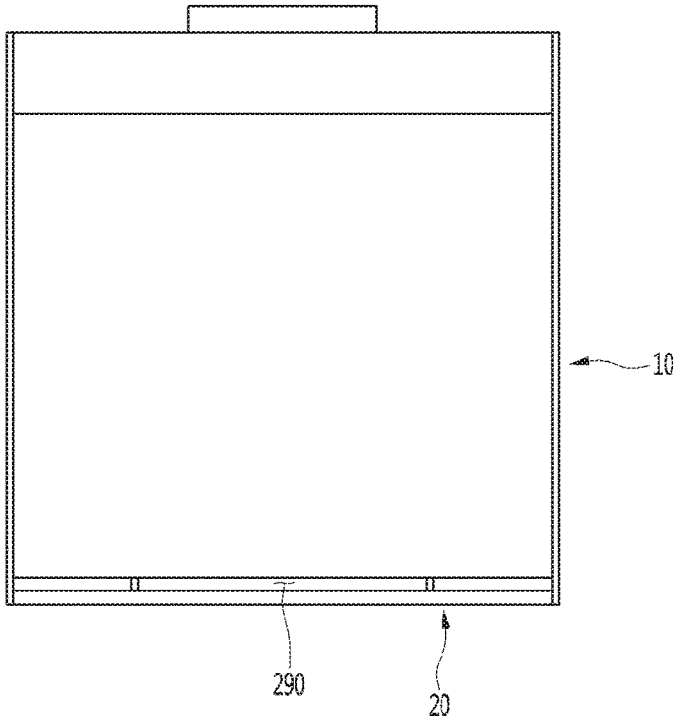
FIG. 3 is a top view of the refrigerator of FIG. 1.

FIG. 1 is a perspective view of a refrigerator according to an embodiment of the present disclosure, FIG. 2 is a perspective view illustrating a state in which a door of FIG. 1 is opened, and FIG. 3 is a top view of the refrigerator of FIG. 1.

Referring to FIGS. 1 to 3, the refrigerator 1 according to an embodiment of the present disclosure may include a cabinet provided with a storage compartment 111, and a door 20 connected to the cabinet 10 to open and close the storage compartment 111.

The cabinet 10 may include an inner case 110 defining the storage compartment 111, and an outer case surrounding the inner case 110.

The outer case 100 may be formed with a metallic material. For example, the outer case 100 may have an aluminum (Al) material. The outer case 100 may be formed by curving or bending at least two times. Alternatively, the outer case 100 may be formed by bonding a plurality of metal plates.

For example, the outer case 100 may include one pair of side panels 102, 103.

The inner case 110 may be positioned between the one pair of side panels 102, 103, and in this state, may be directly or indirectly fixed to the outer case 100.

Front ends 102*a* of the one pair of side panels 102, 103 may be positioned ahead of a front surface of the inner case 110.

In addition, a width of the door 20 in the horizontal direction may be the same as or shorter than a distance between the one pair of side panels 102, 103.

Accordingly, there may be a space between the one pair of side panels 102, 103 to allow the door 20 to be positioned therein.

For example, in a state in which the door 20 closes the storage compartment 111, the door 20 may be positioned between the one pair of side panels 102, 103.

In this case, a front surface of the door 20 may be positioned on the same plane as the front end 102*a* of each of the side panels 102, 103, such that the door 20 and the exterior of the cabinet 10 have a unity when the door 20 closes the storage compartment 111.

That is, the front surface of the door 20 and the front end 102*a* of each of the side panels 102, 103 may define a front surface exterior of the refrigerator 1.

The door 20 may be connected to the cabinet 10 by a rail assembly 90, for example.

Accordingly, the door 20 may be connected to the cabinet 10, and in this state, may slide forward and backward, thereby opening and closing the storage compartment 111.

According to the present disclosure, there is an advantage that, even when the refrigerator 1 is placed in a small space of a kitchen, a living room, or a bed room, the door 20 can be opened and closed without interfering with other surrounding structures since the door 20 opens and closes the storage compartment 111 in a sliding manner.

The rail assembly 90 may have one side connected to the door 20 and the other side connected to the inner case 110.

The door 20 may include a front surface panel 210 of a wood material, and a door liner 230 coupled to a rear surface of the front surface panel 210.

The front surface panel 210 and the door liner 230 may be fastened to each other by a fastening member such as a screw. The front surface panel 210 and the door liner 230 may have a foaming space, and an insulator may be provided between the front surface panel 210 and the door liner 230 by filling the foaming space with a foam liquid.

The door 20 may define a handle space 290 to allow a user's hand to be putted thereinto and to hold the door 20 to open the door 20.

The handle space 290 may be formed by denting down a part of the upper side of the door liner 230, for example.

The handle space 290 may be positioned between the front surface panel 210 and the cabinet 10 in the state in which the door 20 closes the storage compartment 111. Accordingly, in the state in which the door 20 closes the storage compartment 111, the user may put user's hand into the handle space 290 and then open the door 20 by pulling the door 20.

According to the present invention, when the door 20 is closed, a structure like a handle does not protrude outward and thus there is an advantage that an aesthetic design of the refrigerator 1 can be achieved.

A height of the refrigerator 1 is not limited, but may be lower than the average adult's height. As a capacity of the refrigerator 1 is lower, the height of the refrigerator 1 may be lower.

When there exists the handle space 290 on an upper side of the door 20 as described above, the user can easily open the door 20 while the user is standing or seated, even if the height of the refrigerator 1 is reduced.

Upper ends 102*b* of the one pair of side panels 102, 103 may be positioned higher than an upper end of the inner case 110.

Accordingly, a space may be formed on an upper side of the inner case 110, and a cabinet cover 190 may be positioned on the space. The cabinet cover 190 may define an exterior of an upper surface of the cabinet 10. That is, the cabinet cover 190 may define an exterior of an upper surface of the refrigerator 1.

The cabinet cover 190 may be directly fixed to the inner case 110 or may be fixed to a middle plate 150 surrounding the inner case 110.

The cabinet cover 190 may be positioned between the one pair of side panels 102, 103 while covering the inner case 110.

In addition, an upper surface of the cabinet cover 190 may be positioned on the same plane or at the same height as the upper ends 102*b* of the side panels 102, 103, such that the cabinet cover 190 and the exterior of the cabinet 10 have a unity.

The cabinet cover 190 may be formed with a wood material, for example.

According to the present disclosure, since the front surface panel 210 of the door 20 and the cabinet cover 190 are formed with a wood material, respectively, there is an advantage that there is a unity in material between the door 20 and the cabinet cover 190 when the door 20 is closed, and an aesthetic design can be achieved.

Furthermore, when the height of the refrigerator is low, the user may check the cabinet cover 190 with user's naked eyes. Since the cabinet cover 190 is formed with a wood material, a basic aesthetic design can be achieved, and also, the refrigerator 1 can be well harmonized with surrounding furniture of a place where the refrigerator 1 is placed.

The refrigerator 1 of the present disclosure may be used as a table-shaped refrigerator, for example.

The table-shaped refrigerator may perform a function of a table in addition to the function of storing foods. Compared to a typical refrigerator installed in a kitchen, the table-shaped refrigerator may be installed and used beside a bed in a bedroom. According to the present disclosure, since the cabinet cover 190 and the front surface panel 210 are formed with a wood material, the refrigerator 1 can be well harmonized with surrounding furniture even when the refrigerator is placed in a bedroom.

It is preferable that the height of the table-shaped refrigerator is similar to a height of a bed for convenience of users, and the table-shaped refrigerator may have a height lower than that of a typical refrigerator and may have a compact size.

A front surface 190*a* of the cabinet cover 190 may be positioned ahead of the front surface of the inner case 110. Accordingly, the cabinet cover 190 may cover a part of the door liner 230 from above when the door 20 closes the storage compartment 111.

The refrigerator 1 may further include one or more drawer assemblies 30, 40 received in the storage compartment 111.

A plurality of drawer assemblies 30, 40 may be provided in the storage compartment 111 for efficiency of a storage space.

Some of the plurality of drawer assemblies 30, 40 may be fixed to positions in the storage compartment 111, or may be connected to a rail to be slidable by the rail.

Alternatively, some of the plurality of drawer assemblies 30, 40 may be connected to the door 20, and may slide in and out along with the door 20.

Alternatively, some of the plurality of drawer assemblies 30, 40 may be configured to slide out along with the door 20 at the beginning of the opening process of the door 20, and to be stopped when it has slid a predetermined distance.

Hereinafter, a structure of the cabinet 10 will be described in detail.

<Structure of the Cabinet>

Figure 4:
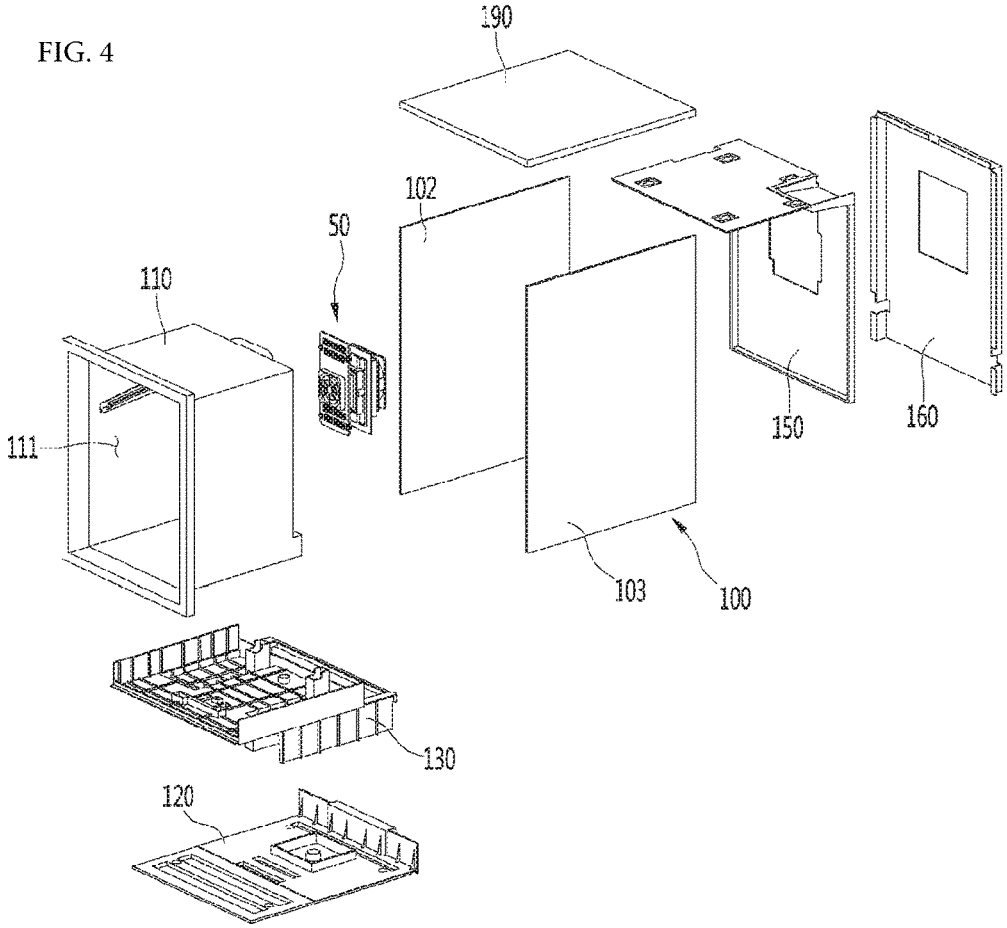
FIG. 4 is an exploded perspective view of a cabinet according to an embodiment of the present disclosure.

FIG. 4 is an exploded perspective view of the cabinet according to an embodiment of the present disclosure.

Referring to FIGS. 1 to 4, the cabinet 10 according to an embodiment of the present disclosure may include the outer case 100, the inner case 110, and the cabinet cover 190.

The outer case 100 may include one pair of side panels 102, 103. The one pair of side panels 102, 102 may define an exterior of a side surface of the refrigerator 1.

The outer case 100 may further include a rear panel 160 defining an exterior of a rear surface of the refrigerator 1.

Accordingly, the exterior of the refrigerator 1 except for the door 20 may be defined by the side panels 102, 103, the cabinet cover 190, and the rear panel 160.

The cabinet 10 may further include a case supporter 130 to support the inner case 110, and a base 120 coupled to a lower side of the case supporter 130.

The cabinet 10 may further include the middle plate 150 to form a foaming space along with the inner case 110. The middle plate 150 may cover an upper side and a rear side of the inner case 110 at a position spaced apart from the inner case 110.

The cabinet 10 may further include a cooling device 50 to cool the storage compartment 111.

Hereinafter, a structure of the cabinet cover 190 will be described in detail.

<Cabinet Cover>

Figure 5:
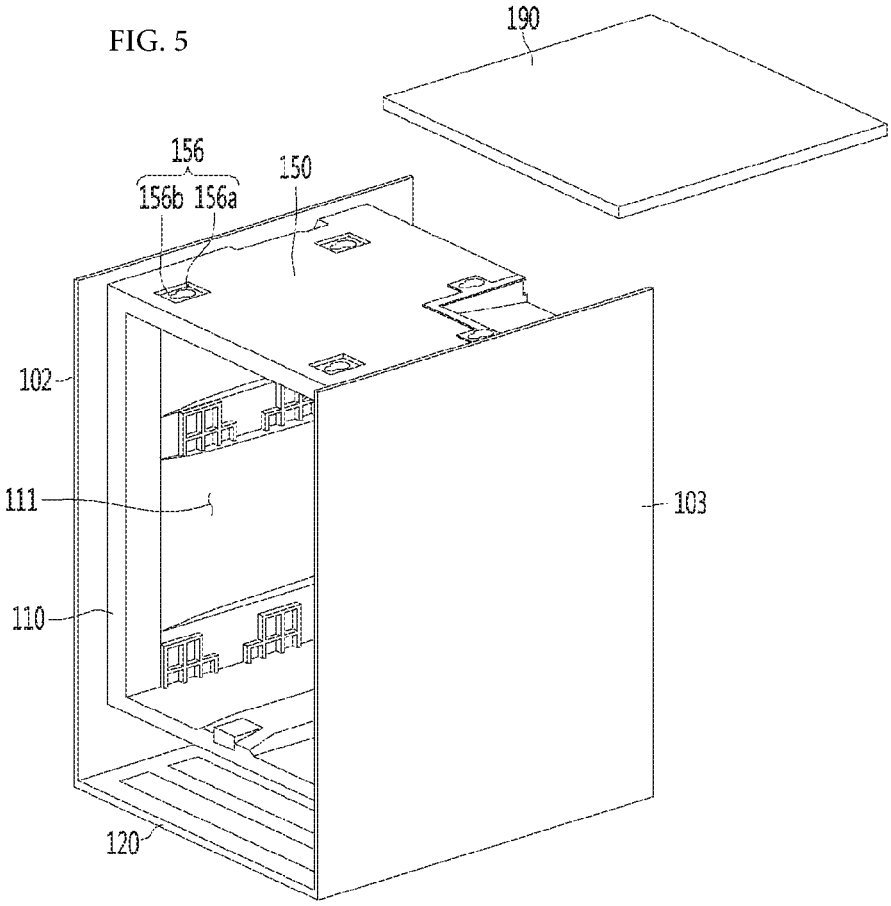
FIG. 5 is a view illustrating the cabinet from which a cabinet cover is separated.
Figure 6:
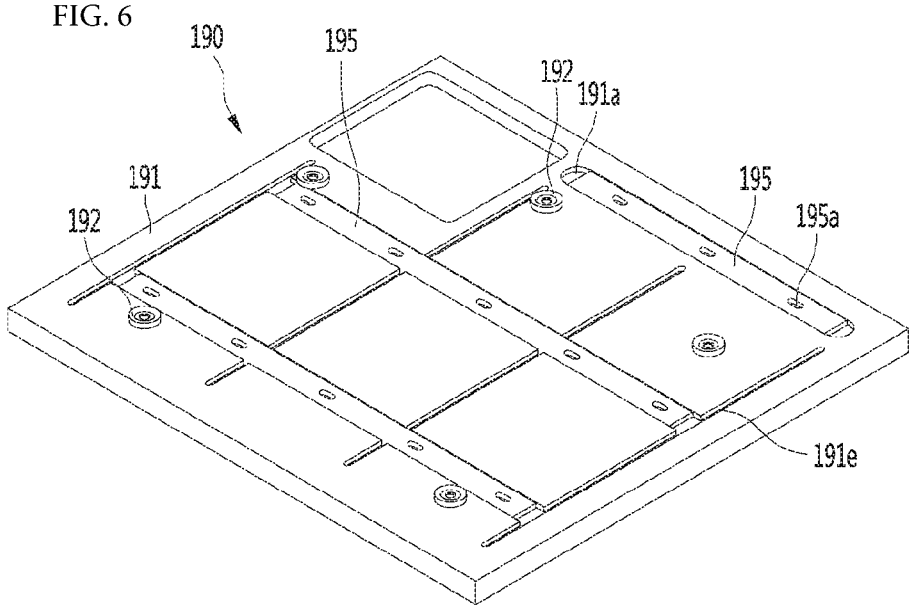
FIG. 6 is a perspective view illustrating the cabinet cover which is downside up.
Figure 7:
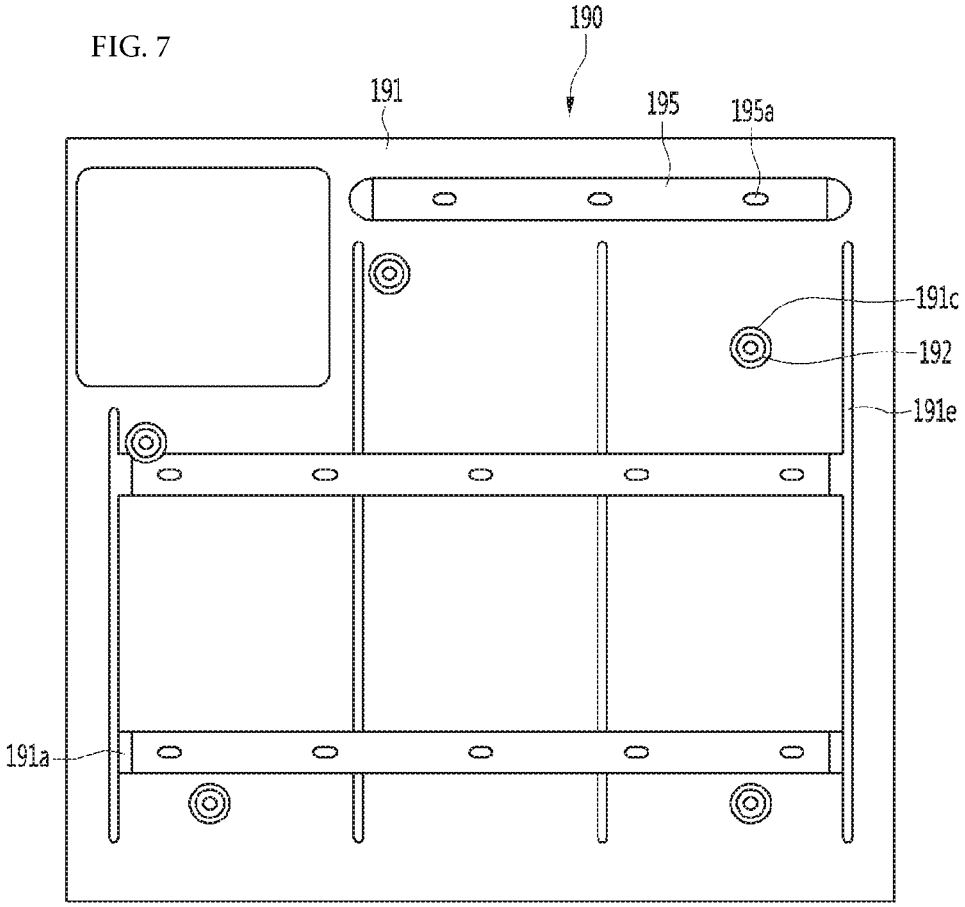
FIG. 7 is a bottom view of the cabinet cover.
Figure 8:
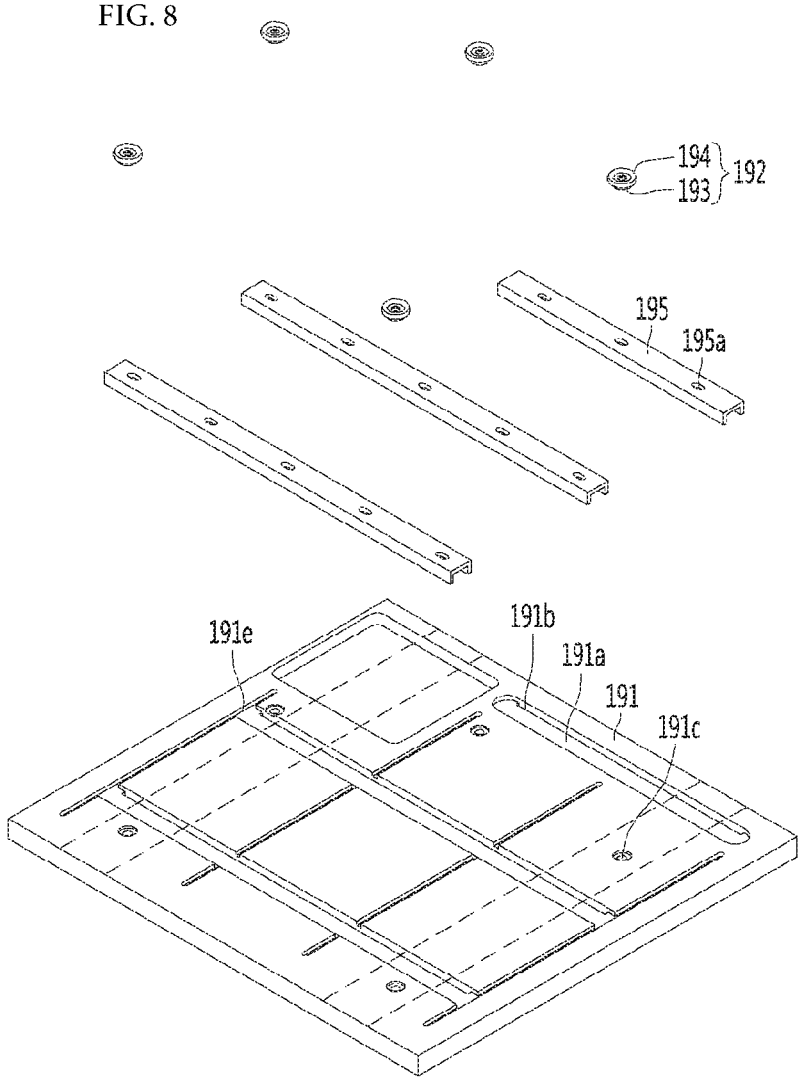
FIG. 8 is an exploded perspective view of the cabinet cover of FIG. 6.

FIG. 5 is a view illustrating the cabinet from which the cabinet cover is separated, FIG. 6 is a perspective view of the cabinet cover which is downside up, FIG. 7 is a bottom view of the cabinet cover, and FIG. 8 is an exploded perspective view of the cabinet cover of FIG. 6.

Referring to FIGS. 5 to 8, a plurality of reinforcing brackets 195 which are formed with a metallic material and are formed in a bar shape may be coupled to a lower surface of the cabinet cover 190 in parallel with one another.

Herein, the lower surface of the cabinet cover 190 refers to a face facing the middle plate 150.

When the bar-shaped reinforcing brackets 195 of the metallic material is coupled to the lower surface of the cabinet cover 190 as described above, deformation of the cabinet cover 190 such as shrinkage and warping can be prevented.

Various embodiments can be applied to a cross section of the reinforcing bracket 195.

For example, the reinforcing bracket 195 may have a squared "C" shape cross section.

Specifically, the reinforcing bracket 195 may include a horizontal portion facing the cabinet cover 190 in parallel, and vertical portions extending from both ends with reference to a main body toward the inside the cabinet cover 190.

The horizontal portion and the vertical portions may be integrally formed with one another. In addition, the vertical portions may be formed by curving both sides of the horizontal portion perpendicularly.

When the reinforcing bracket 195 is formed in the squared "C" shape as described above, the strength of the reinforcing bracket 195 can be enhanced.

In addition, as the strength of the reinforcing bracket 195 is enhanced, deformation of the cabinet cover 190 such as shrinkage and warping can be surely prevented by the reinforcing bracket 195.

In addition, due to the configuration of the vertical portions (portions inserted into the inside of the cabinet cover) of the reinforcing bracket 195, not only deformation of the cabinet cover 190 in a width direction (horizontal direction, but also deformation in a forward-backward direction can be prevented.

In addition, a mounting recess 191*a*, 191*b* may be formed on the lower surface of the cabinet cover 190 to be concave inwardly, and the reinforcing bracket 195 may be inserted into the mounting recess 191*a*, 191*b*.

The mounting recess 191*a*, 191*b* includes a horizontal mounting recess 191*a* in which the horizontal portion of the reinforcing bracket 195 described above is seated, and a vertical mounting recess 191*b* in which the vertical portions of the reinforcing bracket 195 are seated.

The vertical mounting recess 191*b* may be formed on both sides of the horizontal mounting recess 191*a* to be deeper than the vertical mounting recess 191*b*

Due to the configuration of the mounting recess 191*a*, 191*b* described above, the reinforcing bracket 195 may not protrude outward from the cabinet cover 190 and may be kept inserted into the cabinet cover 190.

In addition, the vertical portions of the reinforcing bracket 195 are inserted into the vertical mounting recess 191*b*, such that a coupling force between the reinforcing bracket 195 and the cabinet cover 190 can be enhanced.

In addition, deformation of the cabinet cover 190 in the forward-backward direction (a direction indicated by dashed lines in FIG. 8) can be prevented.

In addition, a length of the mounting recess 191*a* may be longer than a length of the reinforcing bracket 195.

When the length of the mounting recess 191*a* is longer than the reinforcing bracket 195 as described above, clearances can be guaranteed between both ends of the mounting recess 191*a* and both ends of the reinforcing bracket 195.

Accordingly, when the cabinet cover 190 is deformed, there are margins for movement of the reinforcing bracket 195, and a phenomenon in which the reinforcing bracket 195 is deformed or the reinforcing bracket 195 is released from the cabinet cover 190 due to deformation of the reinforcing bracket 195 can be prevented.

In addition, the cabinet cover 190 may be formed with glued laminated wood in which a plurality of planks of hardwood are arranged in parallel with one another and glued to one another.

The glued laminated wood may have a boundary line (see dashed lines in FIG. 8) formed between the planks of hardwood. The boundary line may refer to a glue line along which the planks of hardwood are glued to one another. That is, the plurality of planks of hardwood are glued to one another with reference to the boundary line described above.

In this case, the reinforcing bracket 195 may be formed in parallel with the arrangement direction of the glued laminated wood.

That is, the reinforcing bracket 195 may be formed in a direction intersecting with the boundary line (see dashed lines of FIG. 8) of the glued laminated wood forming the cabinet cover 190.

The glued laminated wood may be greatly deformed in the arrangement direction of the planks of hardwood (the direction perpendicular to the boundary line) due to its characteristics.

However, deformation less occurs in the direction (boundary line direction) perpendicular to the arrangement direction of the hardwood.

Accordingly, when the reinforcing bracket 195 is fixed to the cabinet cover 190 in parallel with the arrangement direction of the glued laminated wood, the strength of the cabinet cover 190 can be increased, and shrinkage, deformation, warping, or the like of the glued laminated wood forming the cabinet cover 190 can be prevented.

In addition, the reinforcing bracket 195 may have a plurality of long holes 195*a* formed on a surface thereof parallel to the lower surface of the cabinet cover 190, and spaced apart from one another in parallel with a longitudinal direction of the reinforcing bracket 195.

The long hole 195*a* is formed lengthways in the longitudinal direction of the reinforcing bracket 195.

When the reinforcing bracket 195 is mounted on the lower surface of the cabinet cover 190, the long hole 195*a* is parallel to the lower surface of the cabinet cover 190. In this state, when the long hole 195*a* and the cabinet cover 190 are fastened to each other by a screw or the like, the reinforcing bracket 195 may be fixed to the cabinet cover 190.

The cabinet cover 190 formed with the glued laminated wood may be deformed as time elapses. Specifically, shrinkage, warping, or the like may occur.

In this case, when a clearance is not guaranteed between the screw and the reinforcing bracket 195, there is a problem that the screw is deformed or the screw is released from the cabinet cover 190 and the reinforcing bracket 195. In addition, a problem that the cabinet cover 190 and the reinforcing bracket 195 are released may consecutively arise.

On the other hand, when the long hole 195*a* is formed on the reinforcing bracket 195 according to the present disclosure, the screw may move along the long hole 195*a* even when the cabinet cover 190 is deformed. Accordingly, the screw is not arbitrarily released from the cabinet cover 190 and the reinforcing bracket 195, and can be kept fastened to the cabinet cover 190 and the reinforcing bracket 195.

That is, the long hole 195 is formed on the reinforcing bracket 195, such that the screw fastening the cabinet cover 190 and the reinforcing bracket 195 can react to shrinkage or warping of the cabinet cover 190.

In addition, a plurality of slit recesses 191*e* which are concave inwardly may be formed on the lower surface of the cabinet cover 190 in parallel with one another.

The slit recess 191*e* may be formed in a direction intersecting with the reinforcing bracket 195. For example, the slit recess 191*e* may be orthogonal to the reinforcing bracket 195.

When the slit recess 191*e* is formed as described above, the strength of the cabinet cover 190 can be enhanced.

In particular, when the cabinet cover 190 is formed with glued laminated wood, shrinkage in the forward-backward direction and the horizontal direction can be prevented.

Specifically, with reference to FIG. 8, shrinkage in the horizontal direction can be prevented by the reinforcing bracket 195, and shrinkage in the forward-backward direction can be prevented by the slit recess 191*e*.

As a result, shrinkage, deformation, warping, or the like of the cabinet cover 190 in the forward-backward direction and the horizontal direction, which is formed with glued laminated wood, can be prevented by the configurations of the reinforcing bracket 195 and the slit recess 191*e*.

The slit recess 191*e* may be formed to penetrate through the mounting recess 191*a* into which the reinforcing bracket 195 is inserted.

In addition, the slit recess 191*e* may be formed not to overlap the boundary line of the glued laminated wood (see dashed lines of FIG. 8) forming the cabinet cover 190.

Accordingly, a phenomenon that thickness of the boundary line (see dashed lines of FIG. 8) of the glued laminated wood is reduced and thus strength of the glued laminated wood declines can be prevented.

In addition, as the slit recess 191*e* is formed as described above, weight of the cabinet cover 190 is reduced and thus the cabinet cover 190 can be easily attached and detached.

In addition, weight of the refrigerator in which the cabinet cover 190 is mounted is reduced and the refrigerator is easier to move.

<Mounting Structure of the Cabinet Cover>

Hereinafter, mounting structures of the cabinet cover 190 and the middle plate 150 will be described.

Figure 9:
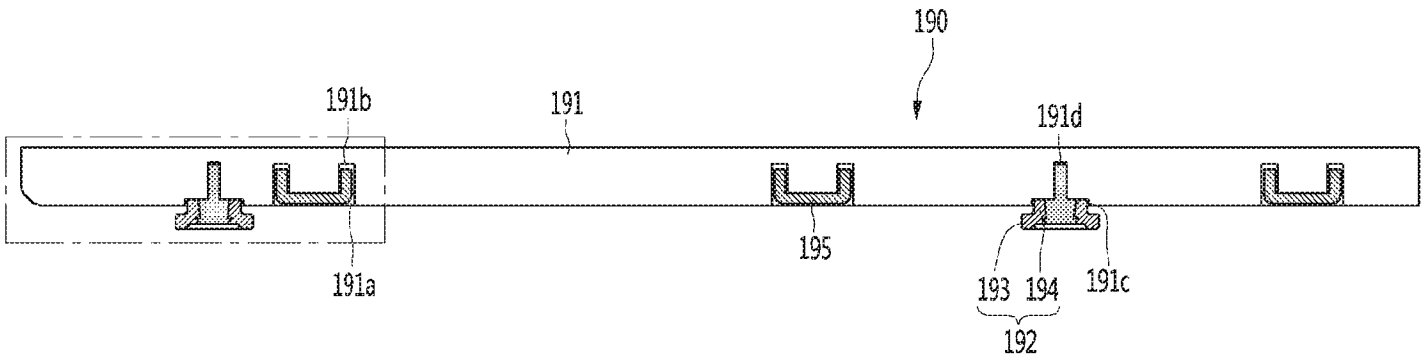
FIG. 9 is a longitudinal section view of the cabinet cover.
Figure 10:
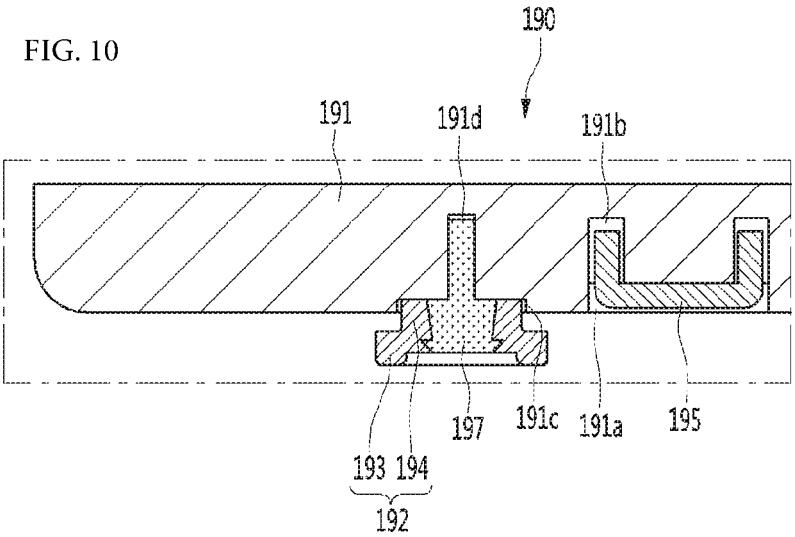
FIG. 10 is a view enlarging some areas of FIG. 9.
Figure 11:
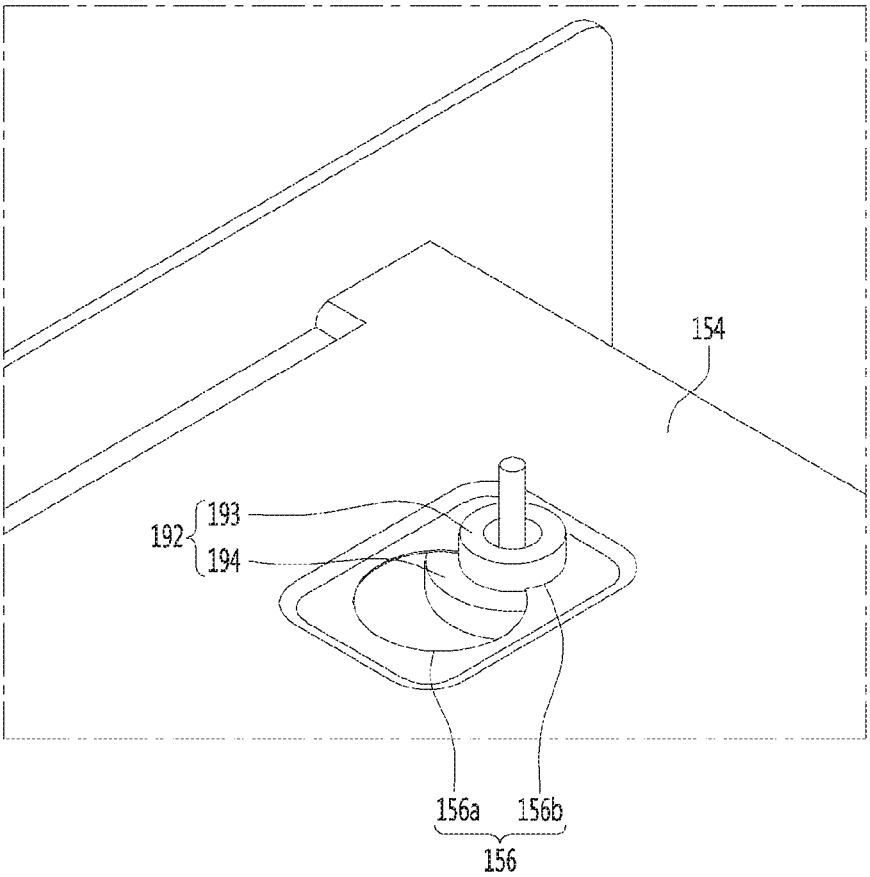
FIG. 11 is a perspective view showing a cover fixing portion coupled to a fixing hole of a middle plate.

FIG. 9 is a longitudinal section view of the cabinet cover, FIG. 10 is a view enlarging some areas of FIG. 9, and FIG. 11 is a perspective view showing a cover fixing portion coupled to a fixing hole of the middle plate.

Referring to FIGS. 9 to 11, the cabinet cover 190 is attachably and detachably coupled to an upper side of the middle plate 150.

To achieve this, a plurality of cover fixing portions 192 are formed on the lower surface of the cabinet cover 190 to be fixed to the middle plate 150.

To securely fix the cabinet cover 190 to the middle plate 150, the plurality of cover fixing portions 192 may be provided on the cabinet cover 190.

The plurality of cover fixing portions 192 may be arranged, being spaced apart from one another in the horizontal direction of the cabinet cover 190, and also, may be arranged, being spaced apart from one another in the forward-backward direction.

The cover fixing portion 192 may be fixed to the cabinet cover 190 by a fastening member 197 penetrating through the cover fixing portion 192 and the cabinet cover 190.

In this case, a fastening recess 191*d* may be formed on the cabinet cover 190 to have the fastening member 197 inserted thereinto.

For example, each of the cover fixing portions 192 may be fixed to a lower surface of the middle plate 150 by a screw.

The cover fixing portion 192 may include a cylindrical first portion 193 having one side contacting the lower surface of the cabinet cover 190 and the other side protruding downward from the cabinet cover 190, and a cylindrical second portion 194 integrally formed with the other side of the first portion 193 and having a diameter larger than the first portion 193.

The first portion 193 is positioned between the cabinet cover 190 and the second portion 194, and the first portion 193 is in contact with the lower surface of the cabinet cover 190.

In addition, a recess 191*c* may be formed on the lower surface of the cabinet cover 190 to receive the one side of the first portion 193. Accordingly, the cover fixing portion 192 may be more stably fixed to the cabinet cover 190.

A cover fixing hole 156 may be formed on the middle plate 150 to have the cover fixing portion 192 fixed thereto. The cover fixing hole 156 may be provided on an upper plate 154, for example.

The cover fixing hole 156 may include a first hole 156*a* which is the same as or larger than the size of the second portion 194 of the cover fixing portion 192, and a second hole 156*b* which is extended from the first hole 156*a* and is smaller than the size of the first hole 156*a*.

The second hole 156*b* may be formed smaller than the second portion 194 of the cover fixing portion 192. In addition, the second hole 156*b* may be the same as or larger than the size of the first portion 193 of the cover fixing portion 192.

To fix the cover fixing portion 192 to the middle plate 150, the second portion 194 of the cover fixing portion 192 and the first hole 156*a* of the cover fixing hole 156 are aligned. Next, the second portion 194 of the cover fixing portion 192 is made to pass through the first hole 156*a* of the cover fixing hole 156.

In the state in which the second portion 194 of the cover fixing portion 192 passes through the first hole 156*a* of the cover fixing hole 156, the first portion 193 of the cover fixing portion 192 is positioned within the first hole 156*a*, and the cabinet cover 190 is seated on the upper plate 154.

In this state, the cabinet cover 190 is moved in the horizontal direction, such that the first portion 193 of the cover fixing portion 192 is positioned in the second hole 156*b* of the cover fixing hole 156. For example, the cabinet cover 190 may be moved forward by sliding.

When the first portion 193 of the cover fixing portion 192 is positioned in the second hole 156*b* of the cover fixing hole 156, the second portion 194 comes into contact with a lower surface of the upper plate 154.

Accordingly, the cabinet cover 190 can be prevented from being released from the middle plate 150 as long as the cabinet cover 190 is not pushed forward.

In the present disclosure, since the cabinet cover 190 is coupled to the middle plate 150 by sliding, the cabinet cover 190 can be easily coupled to the middle plate 150 and can be easily decoupled from the middle plate 150.

In the present disclosure, before the cabinet cover 190 is coupled to the middle plate 150, a foam liquid may be injected into the foaming space 159 with the cover fixing hole 196 being closed by a separate fixing hole cover.

After foaming is completed, the fixing hole cover may be removed and then the cabinet cover 190 can be coupled to the middle plate 150. Accordingly, according to the present disclosure, there is an advantage that the cabinet cover 190 is replaceable. That is, since the cabinet cover 190 having a design or color desired by the user can be coupled to the middle plate 150, there is an advantage that the refrigerator can have various exterior designs.

The invention claimed is:

1. A refrigerator comprising:

a cabinet comprising an inner case that defines a storage compartment therein, and a middle plate that covers an upper surface of the inner case; and a door disposed on a front portion of the cabinet and configured to open and close at least a portion of the storage compartment, wherein the cabinet further comprises:

a cabinet cover that is coupled to an upper side of the middle plate and that defines an upper surface of the cabinet, the cabinet cover comprising a plurality of planks of wood that are arranged in parallel to one another and that are glued to one another, and a plurality of reinforcing brackets that are made of a metallic material, that are coupled to a lower surface of the cabinet cover, and that extend in parallel to one another, and wherein the cabinet cover defines a plurality of mounting recesses that are recessed from the lower surface of the cabinet cover, each of the plurality of mounting recess being configured to receive a reinforcing bracket among the plurality of reinforcing brackets, wherein the cabinet cover further comprises a plurality of cover fixing portions that are disposed on the lower surface of the cabinet cover and that are fixed to the middle plate, and wherein each of the plurality of cover fixing portions comprises:

a first cylindrical portion having a first side contacting the lower surface of the cabinet cover, and a second side protruding downward from the cabinet cover toward the middle plate, and a second cylindrical portion that extends from the second side of the first cylindrical portion and that has a diameter larger than a diameter of the first cylindrical portion.

2. The refrigerator of claim 1, wherein the reinforcing bracket among the plurality of reinforcing brackets has a bar shape, and wherein a length of one of the plurality of mounting recesses is longer than a length of the reinforcing bracket among the plurality of reinforcing brackets.

3. The refrigerator of claim 1, wherein the reinforcing bracket among the plurality of reinforcing brackets extends in parallel to an arrangement direction of the plurality of planks of wood.

4. The refrigerator of claim 1, wherein the reinforcing bracket among the plurality of reinforcing brackets defines a hole at a surface facing the lower surface of the cabinet cover, the hole having an elongated shape that extends along a longitudinal direction of the reinforcing bracket among the plurality of reinforcing brackets.

5. The refrigerator of claim 1, wherein the cabinet cover further defines a plurality of slits that are recessed from the lower surface of the cabinet cover and that extend in parallel to one another.

6. The refrigerator of claim 5, wherein each of the plurality of slits extends in a direction orthogonal to the reinforcing bracket.

7. The refrigerator of claim 5, wherein each of the plurality of slits is spaced apart from an interface between two of the plurality of planks of wood and extends parallel to the interface.

8. The refrigerator of claim 1, wherein the cabinet cover further defines a recess that is recessed from the lower surface of the cabinet cover and that receives the first side of the first cylindrical portion of one of the plurality of cover fixing portions.

9. The refrigerator of claim 1, further comprising a fastening member that passes through one of the plurality of cover fixing portions and that is fixed to the cabinet cover.

10. The refrigerator of claim 1, wherein the middle plate defines a cover fixing hole that receives one of the plurality of cover fixing portions.

11. The refrigerator of claim 10, wherein the cover fixing hole comprises:

a first hole having a size that is greater than or equal to a size of the second cylindrical portion of the one of the plurality of cover fixing portions; and a second hole that extends from the first hole, the second hole having a size that is less than the size of the second cylindrical portion and that is greater than or equal to a size of the first cylindrical portion of the one of the plurality of cover fixing portions.

12. The refrigerator of claim 11, wherein the second cylindrical portion is coupled to the middle plate through the second hole.

13. The refrigerator of claim 1, wherein the first cylindrical portion is disposed vertically between the lower surface of the cabinet cover and the upper side of the middle plate, and wherein the second cylindrical portion is disposed at a lower surface of the middle plate.

14. The refrigerator of claim 1, wherein each of the plurality of reinforcing brackets has a bar shape, and wherein the plurality of reinforcing brackets extend parallel to a side of the cabinet cover.

15. The refrigerator of claim 14, wherein each of the plurality of reinforcing brackets is arranged across the plurality of planks of wood.

16. The refrigerator of claim 1, wherein each of the plurality of reinforcing brackets defines a plurality of holes at a surface facing the lower surface of the cabinet cover, each of the plurality of holes having an elongated shape that extends along a longitudinal direction of the reinforcing bracket.

17. The refrigerator of claim 1, wherein the middle plate further covers a rear surface of the inner case.

18. The refrigerator of claim 1, wherein each of the plurality of planks of wood extends in a first direction, wherein each of the plurality of reinforcing brackets has a bar shape that extends in a second direction across the first direction, and wherein the plurality of reinforcing brackets have different lengths in the second direction.

* * * * *